US009475099B2

(12) United States Patent
Puskas et al.

(10) Patent No.: US 9,475,099 B2
(45) Date of Patent: Oct. 25, 2016

(54) ULTRASONIC CLEANING SYSTEM WITH TRANSDUCER FAILURE INDICATOR

(75) Inventors: Peter J. Puskas, Freeport, IL (US); Steven H. Myers, Lena, IL (US)

(73) Assignee: Ultrasonic Power Corporation, Freeport, IL (US)

( * ) Notice: Subject to any disclaimer, the term of this patent is extended or adjusted under 35 U.S.C. 154(b) by 895 days.

(21) Appl. No.: 12/577,545

(22) Filed: Oct. 12, 2009

(65) Prior Publication Data

US 2011/0083708 A1 Apr. 14, 2011

(51) Int. Cl.
*B08B 3/12* (2006.01)
*B08B 3/00* (2006.01)

(52) U.S. Cl.
CPC .. *B08B 3/12* (2013.01); *B08B 3/00* (2013.01)

(58) Field of Classification Search
CPC ..... B08B 3/00; B08B 3/12
USPC ..... 134/1, 1.3, 113, 201
See application file for complete search history.

(56) References Cited

U.S. PATENT DOCUMENTS 3,596,883 A * 8/1971 Brech ..... B06B 1/0253 134/184
4,236,146 A * 11/1980 Clark et al. ..... 340/517
4,431,975 A 2/1984 Podlesny
4,527,901 A * 7/1985 Cook ..... 366/127
5,276,376 A 1/1994 Puskas
5,587,661 A * 12/1996 Schneider et al. ..... 324/556
5,895,997 A 4/1999 Puskas et al.
6,007,490 A 12/1999 Pawluskiewicz
6,127,530 A 10/2000 Duatti et al.
6,144,194 A * 11/2000 Varga ..... 323/285
6,433,460 B1 8/2002 Puskas
6,595,035 B1 7/2003 Maley
6,624,539 B1 9/2003 Hansen et al.
6,832,516 B1 12/2004 Dam et al.
7,157,058 B2 1/2007 Marhasin et al.
2004/0230116 A1 11/2004 Cowan et al.
2005/0167423 A1 * 8/2005 Buschmann ..... E01C 19/48 219/665
2005/0281420 A1 12/2005 Sekino et al.

FOREIGN PATENT DOCUMENTS

JP 11253879 A * 9/1999

OTHER PUBLICATIONS

Machine Translation of JP 11-253879A, Suzuki et al., Sep. 1999.*
Fleury et al., Safety Issues for HIFU Transducer Design, paper, 8 pages, Joint Dept of Physics, Institute of Cancer Research, United Kingdom.

* cited by examiner

*Primary Examiner* — David Cormier
(74) *Attorney, Agent, or Firm* — Reinhart Boerner Van Deuren P.C.

(57) ABSTRACT

An ultrasonic cleaning system that includes an electrical power supply, and a plurality of ultrasonic transducers coupled in parallel, wherein the plurality of ultrasonic transducers are coupled to the electrical power supply. The ultrasonic cleaning system also includes a transducer fault indicator coupled between the electrical power supply and the plurality of ultrasonic transducers, wherein the transducer fault indicator consists essentially of a current sensing portion configured to detect electrical current, and an alarm mechanism coupled to the current sensing portion. Additionally, the alarm mechanism is configured to provide a signal, indicating a failure of the ultrasonic transducer, based on the magnitude of electrical current detected by the current sensing portion.

11 Claims, 4 Drawing Sheets

ULTRASONIC CLEANING SYSTEM WITH TRANSDUCER FAILURE INDICATOR

FIELD OF THE INVENTION

This invention relates generally to ultrasonic cleaning systems, and, more particularly, to diagnostic circuitry for ultrasonic cleaning systems.

BACKGROUND OF THE INVENTION

Ultrasonic energy is used in a variety of applications including, but not exclusive of, medical, industrial, and military applications. One common use for ultrasonic energy in manufacturing is for cleaning objects in liquids. In ultrasonic cleaning, a transducer, usually piezoelectric but sometimes magnetostrictive, is secured to or immersed in a cleaning tank to controllably impart ultrasonic vibration to the tank. The tank is filled with a cleaning liquid and parts are immersed into the liquid to be cleaned by ultrasonic agitation and cavitation. The ultrasonic energy itself can dislodge contaminants. Under certain conditions, the ultrasonic energy also creates cavitation bubbles within the liquid where the sound pressure exceeds the liquid vapor pressure. When the cavitation bubbles collapse, the interaction between the ultrasonically agitated liquid and the contaminants on the parts immersed in the liquid causes the contaminants to be dislodged.

In a typical ultrasonic cleaning system, the cleaning liquid is an aqueous solution, and parts immersed therein are cleaned via the aforementioned agitation and cavitation of the aqueous solution. Typically, the ultrasonic transducers transmit ultrasonic energy into the liquid-filled tank at frequencies of 18 kilohertz or greater, typically at a resonant frequency of the transducer and the load. The load includes the cleaning tank, the liquid in the tank, and the parts immersed in the liquid. When the ultrasonic transducer is driven at the resonant frequency of the load, the system is capable of delivering maximum power to the load.

Typically, ultrasonic transducers include a drive rod made from either piezoelectric, piezoceramic, or magnetostrictive materials, which oscillate with the frequency of the applied current or voltage. Magnetostrictive materials include aluminum and iron alloys or nickel and iron alloys. Both piezoelectric and piezoceramic materials have been known to fail due to the thermal and mechanical stresses produced during prolonged operation of the transducer. Because it is not always obvious when they occur, these component failures may not be discovered until the end of a lengthy cleaning process. In manufacturing, such failures can be costly, both in terms of the replacement cost of the failed components, and, just as importantly, in terms of the increased cycle time for those parts that cannot be processed until the transducer is repaired.

Additionally, there are also instances when the generator that supplies power to the ultrasonic transducers fails, resulting in a complete loss of power. If there is not an operator watching the tank at the time the generator failure, the loss of power may go undetected. This would result in lost production time and increased cycle times due to additional cleaning cycles.

To provide users of ultrasonic cleaning systems with some warning when an ultrasonic transducer or power generator fails, transducer fault indicators have been developed. However, conventional transducer fault indicators tend to be complex, costly, and may not always provide a simple and convenient method of signaling the user. Further, some conventional transducer fault indicators require stored current or voltage waveform information to serve as a reference against which a comparison of some monitored signal is made. Also, the functionality of some conventional transducer fault indicators may be limited by the normal current fluctuations seen in drive circuits for ultrasonic cleaning systems. Variations in the temperature and level of the cleaning fluid, along with the mass of the parts being cleaned can all affect the amplitude of the current signal supplied to the ultrasonic transducers. This current can vary by as much as 25%-30% as these factors tend to change the characteristics of the load placed on the power supply. Some conventional transducer fault indicators may not operate as intended with this amount of variation.

It would therefore be desirable to have a transducer fault indicator that does not require stored current or voltage waveform information to serve as a reference against which a comparison of some monitored signal is made, and which is not hampered by the normal current fluctuations seen in drive circuits for ultrasonic cleaning systems. Further, the device should be capable of detecting transducer or power generator failures either prior to, or immediately after, occurrence of the failure without the complex and costly circuitry typically found in conventional transducer fault indicators. Embodiments of the invention provide such a system. These and other advantages of the invention, as well as additional inventive features, will be apparent from the description of the invention provided herein.

BRIEF SUMMARY OF THE INVENTION

In one aspect, embodiments of the invention provide an ultrasonic cleaning system that includes an electrical power supply and a plurality of ultrasonic transducers coupled in parallel. The plurality of ultrasonic transducers are coupled to the electrical power supply. The ultrasonic cleaning system also has a transducer fault indicator coupled between the electrical power supply and the plurality of ultrasonic transducers.

In another aspect, embodiments of the invention provide an ultrasonic cleaning system that includes an AC electrical power supply and a first ultrasonic transducer coupled to the AC electrical power supply and configured to transmit ultrasonic energy to a liquid-filled tank. The ultrasonic cleaning system further includes a transducer fault indicator coupled to a line that connects the first ultrasonic transducer to the AC electrical power supply.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
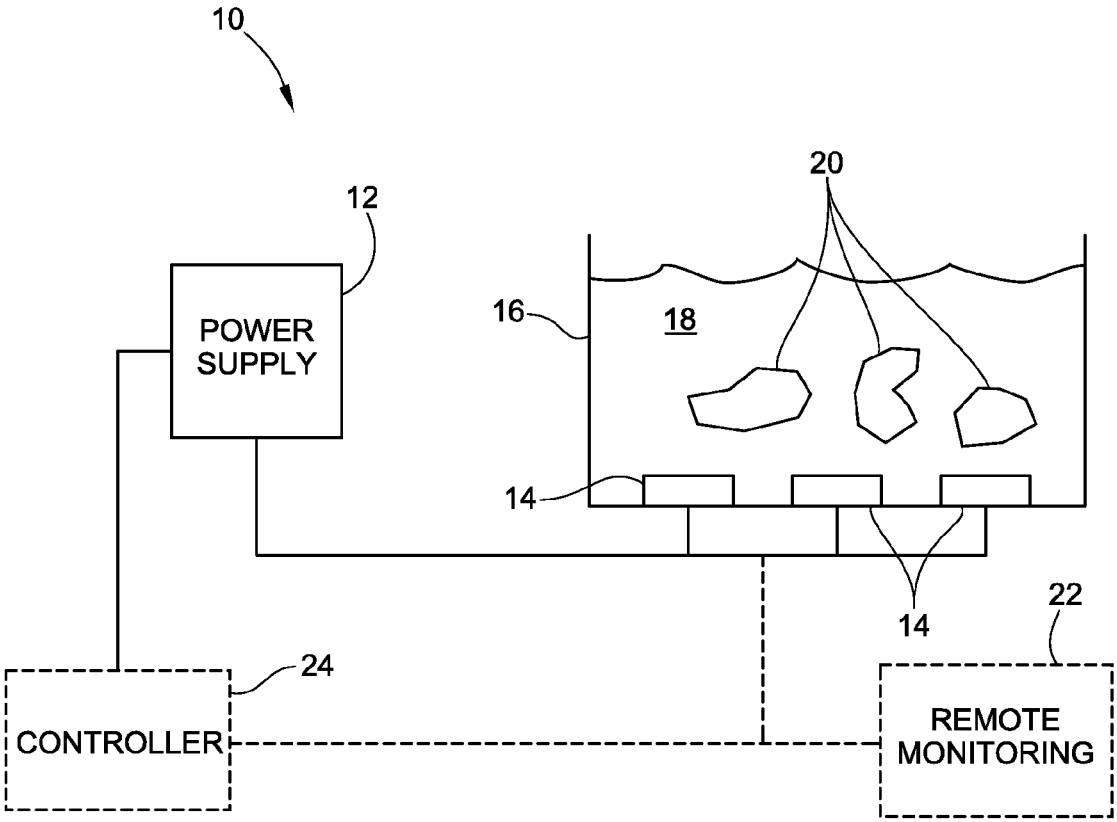
FIG. 1 is a schematic illustration of an exemplary ultrasonic cleaning system incorporating an embodiment of the invention.

FIG. 1 is a schematic illustration of an exemplary ultrasonic cleaning system 10 incorporating an embodiment of the invention. The ultrasonic cleaning system 10 includes an electrical power supply 12, which in one embodiment, supplies AC electrical power to a plurality of ultrasonic transducers 14 which are positioned in a cleaning tank 16. Embodiments of the invention include ultrasonic cleaning systems having a greater number or lesser number of ultrasonic transducers 14 than the three shown in FIG. 1. While the ultrasonic transducers 14 are shown as being positioned at the bottom of cleaning tank 16, the ultrasonic transducers 14 could be mounted on the sides, bottom, or positioned at some other location within the cleaning tank 16. An aqueous cleaning solution 18 fills the cleaning tank 16 enough to sufficiently cover the parts 20 being cleaned. In an alternate embodiment of the invention shown below in FIG. 4, each ultrasonic transducer 14 is electrically coupled to a separate power supply, enabling control of the power supplied to individual transducers. An alternate embodiment of cleaning system 10 includes a connection (shown in phantom) from the circuit driving the ultrasonic transducers 14 to a remote monitoring station 22 (shown in phantom). A controller 24 (shown in phantom) is also connected to the circuit driving the ultrasonic transducers 14, and is connected to the power supply 12.

In operation, power supplied to the ultrasonic transducers 14 by the electrical power supply 12 causes the ultrasonic transducers to transmit acoustical energy into the aqueous cleaning solution 18 thereby producing the agitation and cavitation in the cleaning solution 18 which cleans the parts 20. As will be explained more fully below, the circuit driving the ultrasonic transducers 14 includes a warning device that indicates when one or more of the ultrasonic transducers has failed. In one embodiment, the warning device may transmit a signal to the remote monitoring station 22, such that one operator may monitor a number of such cleaning systems from a single location, and receive a warning of transducer failure for any of those system. Further, it is also contemplated that the warning device may be coupled to a controller 24, which upon receipt of a signal indicating that an ultrasonic transducer has failed, may reduce or terminate all power from the power supply 12 to the ultrasonic transducers 14.

In cases where the electrical power supply 12 fails to supply enough power, or any power at all, the loss of power will be detected by the warning device and a warning will be signaled locally, or transmitted to the remote monitoring station 22. In such an instance, the controller 24 may be programmed to terminate all power from the power supply 12 to the ultrasonic transducers 14 to reduce the amount of wasted energy until the power supply 12 is repaired.

Figure 2:
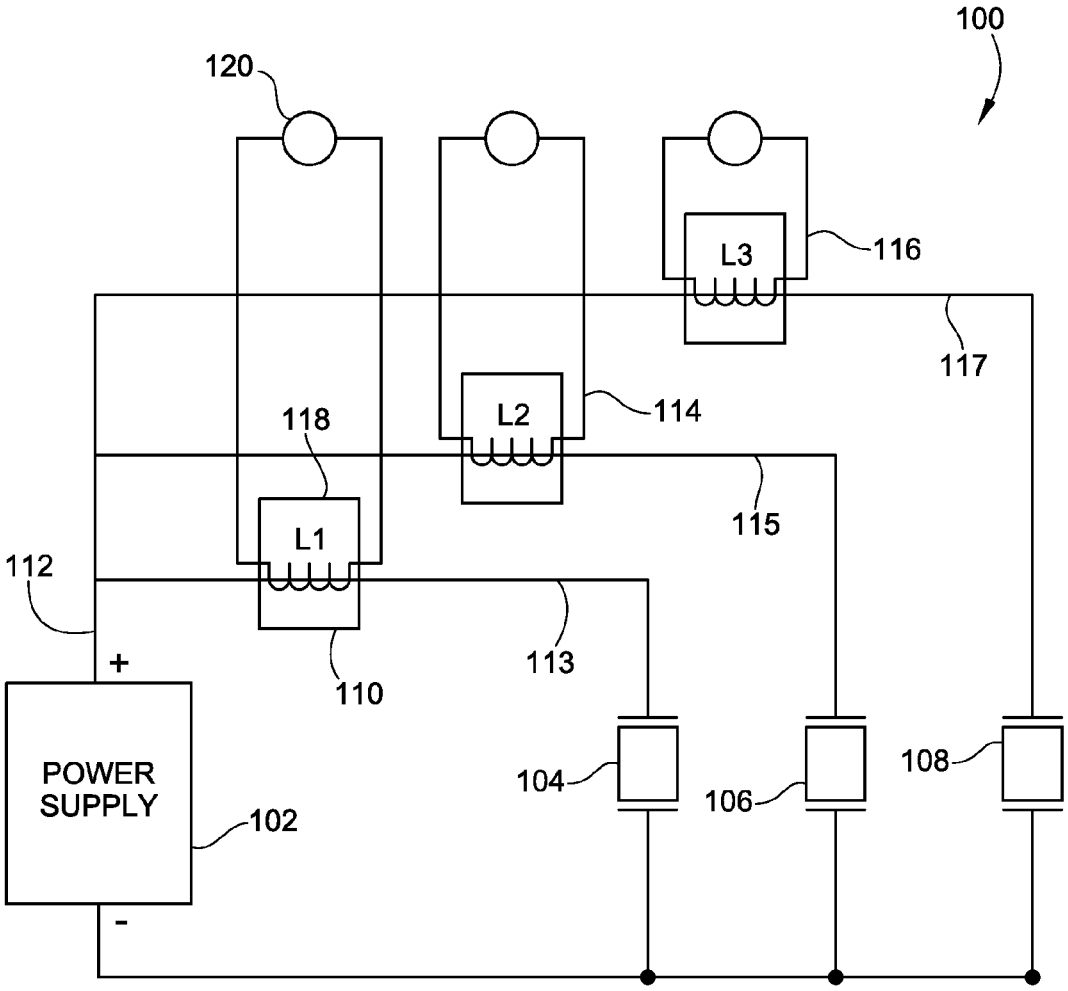
FIG. 2 is a schematic drawing of a drive circuit used in ultrasonic cleaning systems having multiple transducers and multiple transducer fault indicators.
Figure 3:
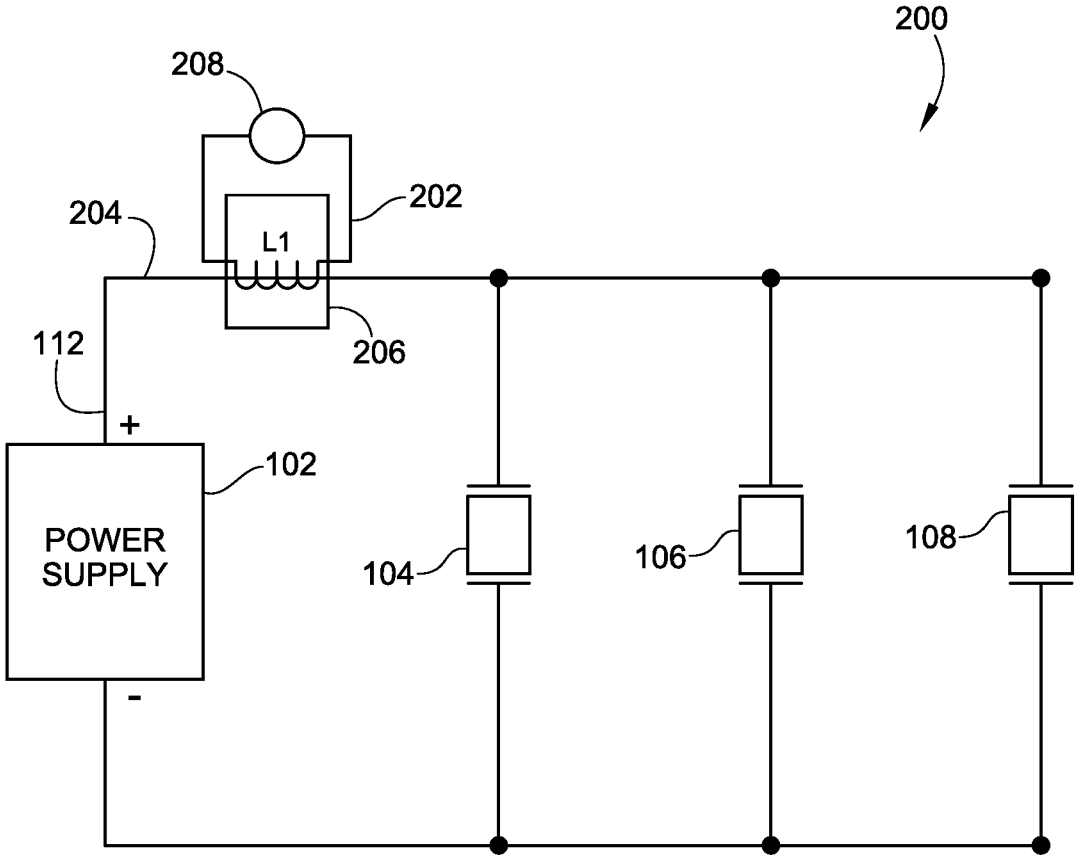
FIG. 3 is a schematic drawing of a drive circuit used in ultrasonic cleaning systems having multiple transducers and a single transducer fault indicator.
Figure 4:
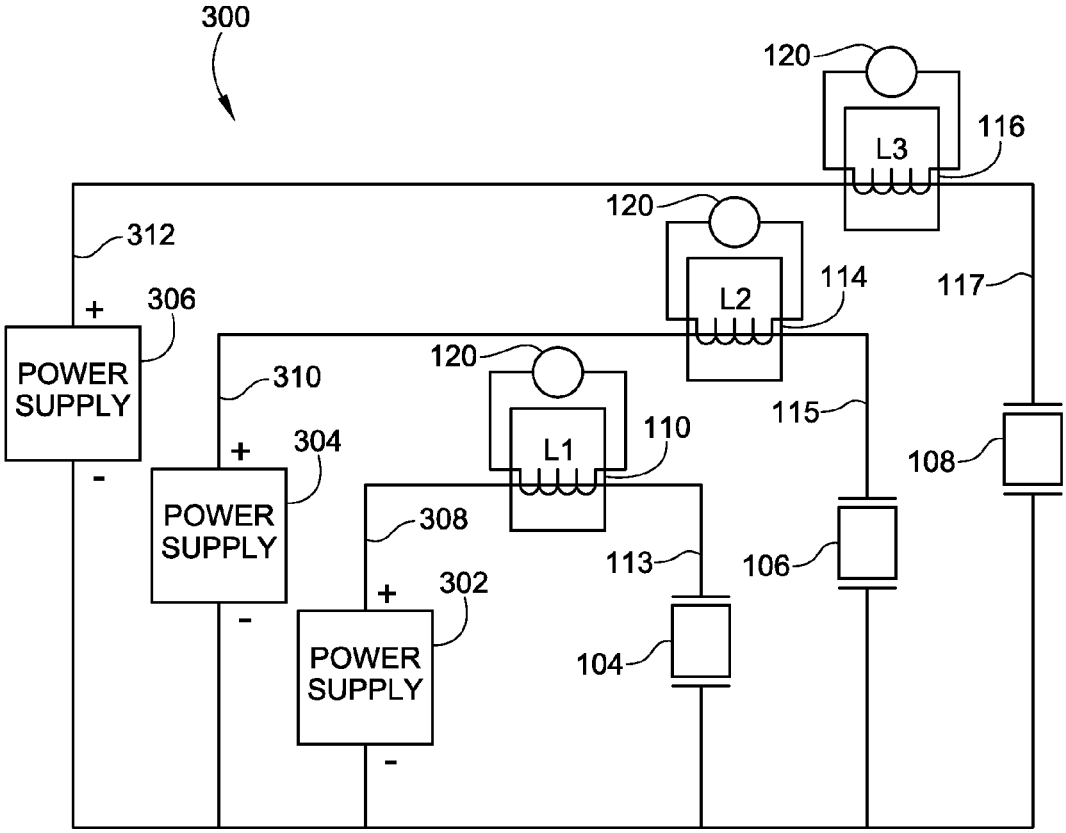
FIG. 4 is a schematic illustration of a drive circuit used in ultrasonic cleaning systems having multiple transducers and multiple power supplies.

FIG. 2 is a schematic diagram of a drive circuit 100 used in an ultrasonic cleaning system, such as that shown in FIG. 1, according to an embodiment of the invention. The drive circuit 100 includes a electrical power supply 102 coupled to a first ultrasonic transducer 104, a second ultrasonic transducer 106, and a third ultrasonic transducer 108, wherein the three ultrasonic transducers are coupled in parallel. In an embodiment of the invention, the electrical power supply 102 is an alternating current (AC) power supply. A first transducer fault indicator 110 is coupled to a first line 113 connecting the positive terminal 112 of the electrical power supply 102 to the first ultrasonic transducer 104. A second transducer fault indicator 114 is coupled to a second line 115 connecting the positive terminal 112 of the electrical power supply 102 to the second ultrasonic transducer 106, and a third transducer fault indicator 116 is coupled to a third line 117 connecting the positive terminal 112 of the electrical power supply 102 to the third ultrasonic transducer 108. While FIGS. 2-4 show the transducer fault indicators connected between one of the transducers and a positive terminal of an electrical power supply, in alternate embodiments of the invention, any of the transducer fault indicators 110, 114, 116 could be connected between the transducer and a negative terminal of the electrical power supply.

Each transducer fault indicator includes a current sensing portion 118 coupled to an alarm mechanism 120. In an embodiment of the invention, the current sensing portion 118 has a current sense transformer. There are two types of current sense transformers. In a wound current sense transformer, the primary winding placed in series with an AC-current-carrying conductor. In a toroidal current sense transformer, the current-carrying conductor functions as a one-turn primary winding. Both types of current sense transformer have a secondary winding that generally includes a resistive element (sometimes called the burden resistor) whose resistance value is chosen such that the voltage across the secondary winding is proportional to the current in the primary winding. Accordingly, linear current sense transformers are configured to generate an output voltage which closely tracks the AC component of the primary-winding current. Non-linear current sense transformers are configured such that for a significant change in the primary-winding current the secondary winding produces a change in output voltage sufficient to trigger a fault circuit or logic device.

Current sense transformers allow current measurement with low power dissipation and electrical isolation of the sensor output from the input signal. The size and type of current sense transformer employed typically depends on the size, frequency, and range of the current being sampled. If the current sense transformer is not rated to handle the amount of current being sampled, the transformer may saturate resulting in circuit failure due to an excessive increase in operating temperature.

In another embodiment of the invention, the current sensing portion 118 is a magnetic current sensor, such as a Hall-effect sensor. A Hall-effect sensor has a current-sensing element that detects electrical current in a conductor from the magnetic field surrounding the conductor. Thus, the Hall-effect sensor does not have to be wired into circuit with the current-carrying conductor, but, instead, only has to be in close proximity to the conductor. Hall-effect sensors may be of the open-loop variety, in which the output voltage of the current-sensing element is proportional to the current in the conductor. Alternatively, closed-loop Hall-effect sensors use the output of the current-sensing element to drive a coil that creates a magnetic field which neutralizes the magnetic field surrounding the conductor.

As mentioned above, an advantage of using Hall-effect sensors to measure current is that the sensors do not have to be wired into the circuit whose current is being measured, as would the wound current sense transformer. For high-current system, for example systems using more than 100 amperes, this translates into increased safety and circuit reliability, faster and simpler sensor installation, and decreased assembly costs. Other advantages of Hall-effect sensors include low power dissipation for open-loop Hall-effect sensors, suitability over a wide dynamic range of current values, as well as suitability for a wide range of signal frequencies. The amplified voltage output of a Hall-effect sensor can be used to operate the alarm mechanism 120.

In an embodiment of the invention, the alarm mechanism 120 is a visual indicator, such as an LED or some similar light-emitting device. In other embodiments, the alarm mechanism 120 includes an audio warning device or an audio warning device in combination with an LED or other visual alarm. In yet other embodiments, the alarm mechanism 120 includes a device configured to generate an electronic signal which may routed to a remote monitoring station or used to control or adjust the operation of the drive circuit 100. If the alarm mechanisms 120 are configured to transmit a signal to indicate failure of any ultrasonic transducer 104, 106, 108, that signal may also be used to control the power supplied to the ultrasonic transducers 104, 106, 108. For example, a short-circuit or open circuit condition in any ultrasonic transducer could trigger the alarm mechanism of the associated transducer fault indicator to immediately shut down the power supply, prompting the repair or replacement of the faulty ultrasonic transducer.

For any of the embodiments described herein, the alarm mechanism 120 is configured to generate some type of signal to warn of a failure in the ultrasonic transducer. As it relates to embodiments of the invention, the terms "generate a signal" or "transmit a signal" may be defined as the presence or absence of some condition related to the particular type of alarm mechanism 120. For example, if the alarm mechanism 120 is a visual warning device such as an LED, depending on the configuration of the alarm mechanism 120, the light either turning on or going out may be used as a signal to indicate transducer failure. Just as the absence of illumination may be the generation of a signal, as defined herein, if the alarm mechanism is a device configured to generate, or transmit, an electronic signal to indicate transducer failure, the absence of voltage from the alarm mechanism 120 may constitute the signal transmission that indicates transducer failure. That is, the signal transmitted by the alarm mechanism 120 to indicate transducer failure could be either high or low.

In operation, the transducer fault indicators 110, 112, 114 are configured to provide warnings via their respective alarm mechanisms 120 if any one of their associated transducers 104, 106, 108 becomes short-circuited or open-circuited. In an exemplary embodiment, in which the electrical power supply is an AC power supply, and where the alarm mechanisms 120 of each transducer fault indicator includes an LED device, the LEDs would be lit during normal transducer operation. An open circuit in one of the ultrasonic transducers 104, 106, 108 would result in zero current in the leg with the faulty transducer, thus causing the associated LED to go out. However, a failure of the electrical power supply 102 resulting in a complete loss of power, or in a substantial loss of power, would cause the light from each of the LEDs to go out.

The LEDs of the transducer fault indicators 110, 112, 114 would also go out in the case of a short circuit across one of the ultrasonic transducers 104, 106, 108, because the leakage inductance in the output transformer (not shown) of the electrical power supply 102 becomes detuned, with respect to the faulty transducer. As explained above, power transfer from the power supply to the ultrasonic transducer is maximized when the power supply operates at the resonant frequency of the transformer load, which in this case is determined by the leakage inductance of the output transformer and the transducer capacitance. However, the capacitance normally exhibited by the ultrasonic transducer is not present when the transducer short circuits. Without this capacitance, the circuit cannot operate at its resonant frequency, resulting in a substantial loss of power to the ultrasonic transducer. Because the output transformer presents only the high impedance from the leakage inductance to the short-circuited transducer, the current, in the leg of the circuit with the faulty transducer, drops significantly, causing the alarm mechanism 120 of the transducer fault indicator to show that the transducer has failed.

In alternate embodiments, a short or open circuit in one of the ultrasonic transducers 104, 106, 108 would cause the alarm mechanism 120 of the associated transducer fault indicator to trigger an audio alarm, or, in yet another embodiment, to transmit an electronic signal to a remote monitoring station. In the case where the alarm mechanisms 120 are configured to transmit a signal to a remote monitoring station, that same signal could also be transmitted to a controller (not shown) configured to terminate circuit operation if any one of the ultrasonic transducers fails, i.e., becomes open-circuited or short-circuited. These alternate embodiments of the alarm mechanism 120 are also configured to signal or transmit an alarm if the electrical power supply 102 fails. In some embodiments, it may be necessary to supply these audio or signal-generating alarm mechanisms 120 with a separate power source, such as a battery, to operate the warning devices when there is no power available from the power supply 102.

FIG. 3 is a schematic illustration of a drive circuit 200 used in an ultrasonic cleaning system, such as that shown in FIG. 1, according to an embodiment of the invention. The drive circuit 200 includes the electrical power supply 102 coupled to the first ultrasonic transducer 104, the second ultrasonic transducer 106, and the third ultrasonic transducer 108, wherein the three ultrasonic transducers are coupled in parallel. In alternate embodiments of the invention, the drive circuit 200 includes a plurality of ultrasonic transducers that number more or less than three. A transducer fault indicator 202 is coupled to a line 204 that connects the positive terminal 112 of the electrical power supply 102 to a common terminal of the three ultrasonic transducers 104, 106, 108.

In an alternate embodiment, the transducer fault indicator 202 is coupled between a common terminal of the ultrasonic transducers 104, 106, 108 and a negative terminal of the electrical power supply 102. In an exemplary embodiment, the electrical power supply 102 is an AC power supply. The transducer fault indicator 202 includes a current-sensing portion 206 coupled to an alarm mechanism 208. The current-sensing portion 206 may be a current sense transformer or a Hall-effect sensor according to embodiments of the invention. The alarm mechanism 208 may include an audio warning device and/or a visual warning device, such as an LED, and may also include a device configured to generate an electronic signal that can be routed to a remote monitoring station, or used to control or adjust the operating parameters of the drive circuit 200. In some embodiments, it may be necessary to supply these audio or signal-generating alarm mechanisms 208 with a separate power source, such as a battery, to operate the warning devices when there is no power available from the power supply 102.

In operation, the transducer fault indicator 202 is configured to provide a warning via the alarm mechanism 208 if any one of the ultrasonic transducers 104, 106, 108 becomes short-circuited or open-circuited. In an exemplary embodiment where the alarm mechanism 208 includes an LED or similar device, the LED would be lit during normal operation. A short circuit or open circuit in one of the ultrasonic transducers 104, 106, 108 would cause the LED to go out. Similarly, a failure of the electrical power supply 102 resulting in a complete loss of power, or in a substantial loss of power, would cause the light from the LED to go out.

FIG. 4 is a schematic illustration of a drive circuit 300 used in an ultrasonic cleaning system, such as the one shown in FIG. 1, according to an embodiment of the invention. The drive circuit 300 is similar to drive circuit 100 shown in FIG. 2, but wherein each transducer in drive circuit 300 is coupled to a separate power supply. Drive circuit 300 includes a first power supply 302 is coupled to the first transducer 104. The first transducer fault indicator 110 is coupled to a first line 113 that connects a positive terminal 308 of the first power supply 302 to the first ultrasonic transducer 104. The second transducer fault indicator 114 is coupled to a second line 115 that connects a positive terminal 310 of a second power supply 304 to the second ultrasonic transducer 106, and the third transducer fault indicator 116 is coupled to a third line 117 connecting a positive terminal 312 of a third power supply 306 to the third ultrasonic transducer 108. As in the previous embodiments, it is contemplated that the transducer fault indicators 110, 114, 116 could be connected between the ultrasonic transducers 104, 106, 108 and a negative terminal of the power supplies 302, 304, 306.

In alternate embodiments of the invention, the drive circuit 300 includes a plurality of ultrasonic transducers that number more or less than three. In an exemplary embodiment, the first, second, and third electrical power supplies 302, 304, 306 are AC power supplies. Each of the transducer fault indicators 110, 114, 116 includes the current-sensing portion 118 coupled to the alarm mechanism 120. The current-sensing portion 118 may be a current sense transformer or a Hall-effect sensor according to embodiments of the invention. The alarm mechanism 120 may include an audio warning device and/or a visual warning device, such as an LED, and may also include a device configured to generate an electronic signal that can be routed to a remote monitoring station, or used to control or adjust the operating parameters of the drive circuit 300. In some embodiments, it may be necessary to supply these audio or signal-generating alarm mechanisms 120 with a separate power source, such as a battery, to operate the warning devices when there is no power available from the associated power supply 302, 304, 306.

In operation, each of the transducer fault indicators 110, 114, 116 is configured to provide a warning via its alarm mechanism 120 if its associated ultrasonic transducer becomes short-circuited or open-circuited. In an exemplary embodiment where the alarm mechanism 120 includes an LED or similar device, the LED would be lit during normal transducer operation. A short circuit or open circuit in one of the ultrasonic transducers 104, 106, 108 would cause the LED to go out. Additionally, a failure in any one of the electrical power supplies 302, 304, 306 would cause the light from the associated LED to go out.

In an alternate embodiment of the invention, the alarm mechanism 120 is configured to generate a signal to indicate that its associated ultrasonic transducer has become short-circuited or open-circuited. For example, the signal transmitted by the alarm mechanism 120 may be normally high, or normally low, when its associated ultrasonic transducer is functioning normally. However, if any transducer 104, 106, 108 becomes short-circuited or open-circuited, the signal from the alarm mechanism 120 of its associated transducer fault indicator will change states to be low, or high, to indicate that the transducer has failed. That signal, transmitted by the alarm mechanism 120, could be used to control the power supplied to the failed ultrasonic transducer. Because, in the embodiment of FIG. 4, power is supplied to each ultrasonic transducer 104, 106, 108 by a separate power supply 302, 304, 306, the transducers 104, 106, 108 can be controlled individually, allowing the still-functioning transducers to operate, while the failed transducer is taken offline.

Due to the configuration of the transducer fault indicators used in embodiments of the invention, the drive circuits described herein will function as intended despite the aforementioned current fluctuations typically experienced in drive circuits for ultrasonic cleaning systems. As configured, the claimed transducer fault indicator can easily tolerate a 30% current variation, as it will typically signal a transducer failure only when the current drops by at least 80% from nominal.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An ultrasonic cleaning system comprising:

an AC electrical power supply;

a first ultrasonic transducer coupled to the AC electrical power supply and configured to transmit ultrasonic energy to a liquid-filled tank; and a transducer fault indicator operatively coupled to a line that connects the first ultrasonic transducer to the AC electrical power supply;

wherein the transducer fault indicator comprises:

a current sensor configured to monitor a current flow to the first ultrasonic transducer; and an LED coupled in series with the current sensor and powered therefrom; and wherein the transducer fault indicator is configured to generate a signal to indicate failure of at least one of the first ultrasonic transducer or the AC electrical power supply without comparing the current flow sensed by the current sensor to a reference.

2. The ultrasonic cleaning system of claim 1, further comprising one or more ultrasonic transducers coupled in parallel to the first ultrasonic transducer, and wherein the one or more ultrasonic transducers are configured to transmit ultrasonic energy to the liquid-filled tank.

3. The ultrasonic cleaning system of claim 2, wherein each of the one or more ultrasonic transducers has a transducer fault indicator coupled to a line that connects the ultrasonic transducer to the AC electrical power supply.

4. The ultrasonic cleaning system of claim 1, further comprising one or more ultrasonic transducers and one or more AC electrical power supplies such that each ultrasonic transducer is supplied power from a separate AC electrical power supply.

5. The ultrasonic cleaning system of claim 4, further comprising a transducer fault indicator coupled between each of the one or more ultrasonic transducers and its respective AC electrical power supply.

6. The ultrasonic cleaning system of claim 1, wherein the transducer fault indicator further comprises an audio warning device.

7. The ultrasonic cleaning system of claim 1, wherein the transducer fault indicator further comprises a device configured to generate an electronic signal that can be routed to a remote monitoring station.

8. The ultrasonic cleaning system of claim 7, wherein the electronic signal is used to control the amount of power supplied to the first ultrasonic transducer.

9. The ultrasonic cleaning system of claim 1, wherein the current sensor is a current sense transformer.

10. The ultrasonic cleaning system of claim 1, wherein the current sensor is a Hall-effect sensor.

11. The ultrasonic cleaning system of claim 1, wherein the transducer fault indicator is configured to provide an alarm signal in the event of a short circuit or in the event of an open circuit across the first ultrasonic transducer.

* * * * *